US006677719B2

(12) United States Patent
Ortmeyer, II

(10) Patent No.: US 6,677,719 B2
(45) Date of Patent: Jan. 13, 2004

(54) BALLAST CIRCUIT

(75) Inventor: Clifford J. Ortmeyer, II, McHenry, IL (US)

(73) Assignee: STMicroelectronics, Inc., Carrollton, TX (US)

( * ) Notice: Subject to any disclaimer, the term of this patent is extended or adjusted under 35 U.S.C. 154(b) by 0 days.

(21) Appl. No.: 10/161,183

(22) Filed: Jun. 3, 2002

(65) Prior Publication Data

US 2003/0222597 A1 Dec. 4, 2003

(51) Int. Cl.[7] ..... G05F 1/00; H05B 37/00
(52) U.S. Cl. ..... 315/291; 315/307
(58) Field of Search ..... 315/291, 307, 315/224, 209, DIG. 7

(56) References Cited

U.S. PATENT DOCUMENTS 5,289,084 A 2/1994 Nuckolls et al. ..... 315/247
5,877,592 A 3/1999 Hesterman et al. ..... 315/106
6,031,342 A 2/2000 Ribarich et al. ..... 315/291
6,144,539 A * 11/2000 Konopka et al. ..... 361/91.2
6,150,773 A * 11/2000 Ribarich et al. ..... 315/291
6,188,184 B1 2/2001 Eberson et al. ..... 315/307
6,194,841 B1 2/2001 Takahashi et al. ..... 315/224
6,198,232 B1 3/2001 Marinus et al. ..... 315/290
6,211,623 B1 * 4/2001 Wilhelm et al. ..... 315/224
6,281,641 B1 8/2001 Chen et al. ..... 315/307
6,288,630 B1 9/2001 Bardouillet ..... 340/310.01
6,525,492 B2 * 2/2003 Ribarich ..... 315/291

* cited by examiner

*Primary Examiner*—Don Wong
*Assistant Examiner*—Minh D A
(74) *Attorney, Agent, or Firm*—Lisa K. Jorgenson; Christopher F. Regan

(57) ABSTRACT

A ballast circuit and method for operating a lamp includes a lamp preheat/ignition circuit for preheating and igniting the lamp. A ballast controller integrated circuit is operatively connected to the preheat/ignition circuit wherein the lamp preheat/ignition circuit is operatively controlled in a a) preheating mode wherein the lamp is preheated at a preheating frequency for a predetermined period of time; b) a user programmable intermediate ignition mode wherein the lamp is heated at an intermediate ignition frequency that is lower than the preheating frequency; and c) an operating mode wherein the lamp is operated at a final operating frequency that is lower than the intermediate ignition frequency.

32 Claims, 3 Drawing Sheets

BALLAST CIRCUIT

FIELD OF THE INVENTION

This invention relates to the field of ballast circuits, and more particularly, this invention relates to ballast circuits using a ramped ignition frequency.

BACKGROUND OF THE INVENTION

Ballast circuits are commonly used for operating a lamp to prevent the sudden, large increases in voltage supplied to the lamp that could result in malfunction or damage to the lamp. Ballast circuits also control operation of a lamp using a preheating mode and an operating mode. For example, a fluorescent ballast typically operates a fluorescent lamp using circuits known to those skilled in the art. These circuits usually provide for some form of filament preheating to extend the operating life of the lamp.

One prior art circuit for preheating the lamp filaments applies a high-frequency current at a low voltage level. As the filaments are heated, the emissions from the filaments help to lower the voltage at which the lamp will ignite. This voltage at which a lamp ignites depends on many factors, including the lamp type, the preheating of the filaments, and the ambient temperature. For example, ballast control integrated circuits are commonly used and have varying methods to control the preheating time, oscillator frequency, the ignition frequency, and final operating frequencies.

These prior art circuits, however, do not provide adequate control over the preheating and ignition profile, which is important for operating efficiency among different types of lamps.

SUMMARY OF THE INVENTION

It is therefore an object of the present invention to provide a ballast circuit having a programmable intermediate frequency.

It is another object of the present invention to provide a ballast circuit that overcomes the disadvantages as noted above.

The present invention advantageously changes an ignition frequency ramp profile for a ballast circuit from a linear ramp to a ramp that has a programmable intermediate frequency and an adjustable time period. In accordance with one aspect of the present invention, the ballast circuit for operating a lamp includes a lamp preheat/ignition circuit for preheating and igniting the lamp. A ballast controller integrated circuit is operatively connected to the preheat/ignition circuit, wherein the lamp preheat/ignition circuit is operably controlled in a:

a) preheating mode wherein the lamp is preheated at a preheating frequency for a predetermined period of time;

b) a user programmable intermediate ignition mode wherein the lamp is heated at an intermediate ignition frequency that is lower than the preheating frequency; and c) an operating mode wherein the lamp is operated at a final operating frequency that is lower than the intermediate ignition frequency.

In yet another aspect of the present invention, the lamp preheat/ignition circuit includes a preheat capacitor that is operatively connected to the ballast controller integrated circuit. This preheat capacitor is charged at a constant current during the preheating mode. The preheat capacitor is discharged and charged a second time at a different constant current from that used in the preheating mode during which the frequency drops from the intermediate ignition frequency to the final operating frequency in a linear manner. The lamp preheat/ignition circuit also includes at least one capacitor and a pair of operational amplifiers operative with the preheat capacitor and having an inverting input and an output for switching among the preheating, intermediate ignition, and operating modes.

In yet another aspect of the present invention, the lamp preheat/ignition circuit includes a preheat capacitor and differential amplifier circuit. An operational amplifier circuit is operatively connected to the ballast controller integrated circuit and lamp/preheat ignition circuit for resetting operation of the ballast circuit.

A method aspect of the present invention is also disclosed for operating a ballast circuit for a lamp by charging the preheat capacitor to establish a preheating time period for the lamp at a preheating frequency and discharging the preheat capacitor while establishing a user programmable intermediate ignition frequency for the lamp that is lower than the preheating frequency. The preheat capacitor is discharged and then recharged and a final operating frequency for the lamp established that is lower than the intermediate ignition frequency.

The method also includes the step of initially charging the preheat capacitor at a preheating frequency at a constant current, discharging the preheat capacitor, and recharging the preheat capacitor at a constant current different from the current used to charge initially the preheat capacitor. The frequency is lowered in a linear manner from the intermediate ignition frequency for the lamp to the final operating frequency during the recharging of the preheat capacitor.

In yet another aspect of the present invention, the preheat frequency can be set at a maximum programmed oscillator frequency that is output from the ballast controller integrated circuit. The final operating frequency can be set as a minimum programmed oscillator frequency that is output from the ballast controller integrated circuit. The preheating time period can be established by the time period it takes for the capacitor to charge up to a predetermined voltage. The ballast circuit can be reset using a operational amplifier circuit. The final output frequency can be established by a reference within the ballast controller integrated circuit with the use of additional passive components tied to the controller.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The circuit of the present invention changes the ignition frequency ramp profile from a linear ramp to a ramp that has a programmable intermediate frequency with an adjustable time period. This circuit is advantageous over prior art lamp circuits that operate a fluorescent lamp and have some form of filament preheating to extend the operating life of the lamp. For example, one prior art circuit for preheating the lamp filaments applies a high frequency current at a low voltage level. As the filaments are heated, the emissions from the filaments help to lower the voltage at which the lamp will ignite. The voltage at which the lamp ignites depends on many factors, including the lamp type, the preheating of the filaments, and ambient temperature. The present invention uses a ballast control integrated circuit that not only controls the preheat time and oscillator frequency, but also controls the ignition frequency and operating frequencies, but also provides a programmable intermediate frequency in conjunction with a lamp preheat/ignition circuit.

Figure 1:
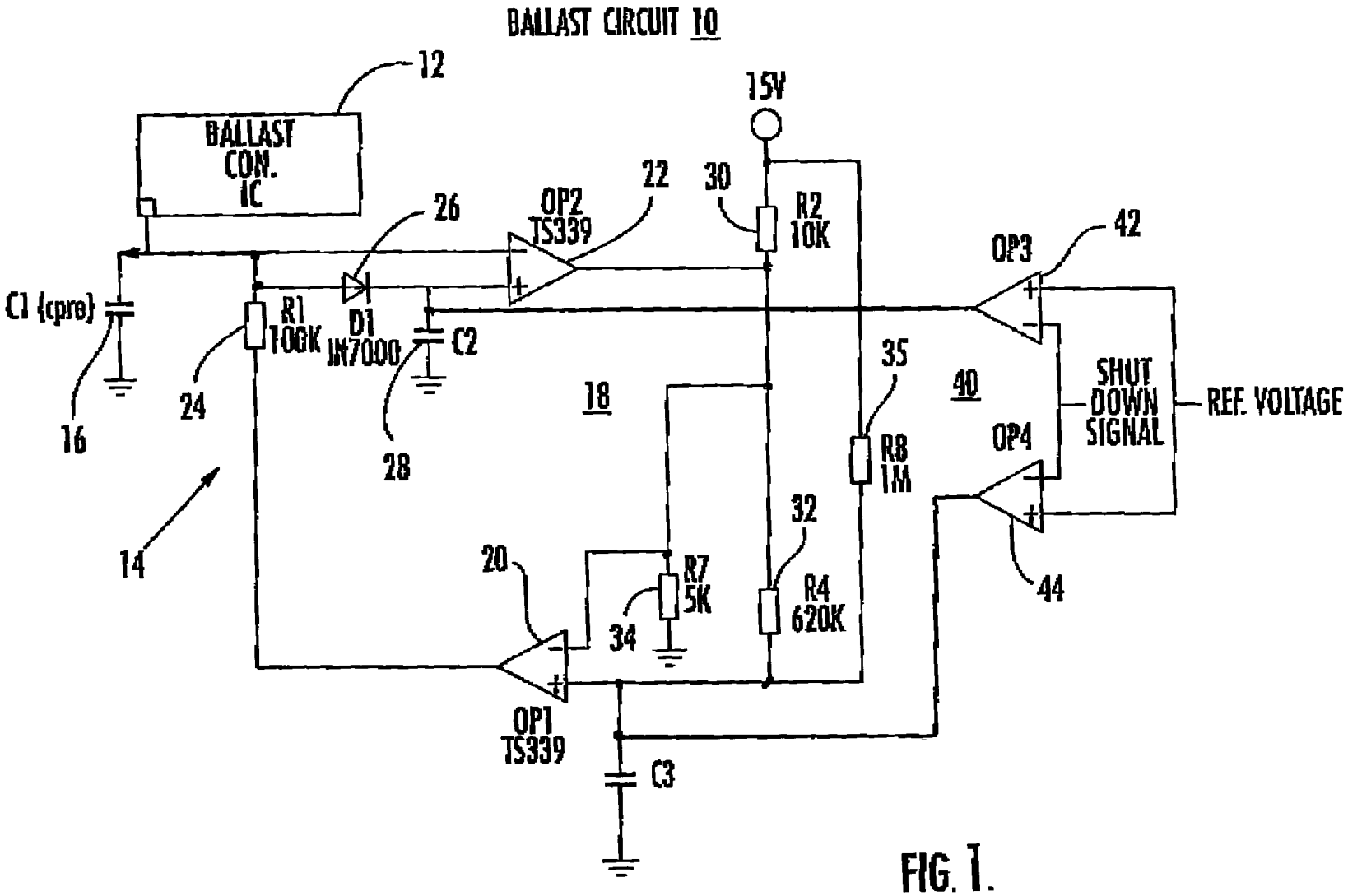
FIG. 1 is a schematic circuit diagram of the ballast frequency control circuit of the present invention.

The circuit of the present invention is shown in FIG. 1 and allows a change in the profile of the existing, "ignition" oscillator frequency ramp.

For purposes of description, a brief listing of the various components used in the circuit shown in FIG. 1 is set forth followed by further details of the components and operation of the circuit.

As illustrated, the ballast circuit 10 includes a ballast controller integrated circuit (IC) 12 also referred to as a CFL/TL ballast driver preheat and dimming circuit, which is operatively connected to a lamp preheat/ignition circuit 14. This circuit includes a preheat capacitor 16 and a differential amplifier circuit 18, including first and second operational amplifiers (OP1, OP2) 20, 22. A look resistor (24), R1, diode (26) D1 and capacitor (28) C2 are arrayed in a "pi" circuit configuration and provide an input to the plus (+) input of the second operational amplifier 22, which has an output to a circuit line connection between two resistors (30, 32), R2 and R4, which, are connected to the 15 volt supply.

The operational amplifier 20 has an input that is fed by power provided from circuit line having resistors (30, 32) R2 and R4 and grounded resistor R7 (39). R2, R4 and R7 can have representative resistor values of 10K, 620K, and 5K, as non-limiting examples. 1M resistor R8 (35) is connected between the power and input for first operational amplifier 20. The diode D1 could be a 1N 7000 diode known to those skilled in the art. The other input for operational amplifier 20 is operatively connected to C3 (36). A second operational amplifier circuit 40 includes differential amplifiers (42, 42) OP3 and OP4, which are connected to reference voltage and provide a shut down signal for resetting the ballast circuit.

The present invention advantageously uses a CFL/TL ballast driver preheat and dimming circuit, such as commonly manufactured and sold by STMicroelectronics, Inc. under the designation L6574.

As basic background, the L6574 integrated circuit is a 16-pin integrated circuit device having voltage ratings in excess of 600 volts and manufactured with BCD off-line technologies and can drive two power MOSFETS in classical half bridge topology in many prior art circuits. It can include a dedicated timing section and an OP amp to implement closed loop control. An integrated boot strap section eliminates a boot strap diode and Zener clamping on Vs.

It typically is arranged as a 16-pin configuration having a preheat timing capacitor Cpre. A table of various pin descriptions is shown below as Table I. The chip can be configured in a circuit in many different circuit designs as suggested to those skilled in the art.

TABLE I

IC PIN DESCRIPTION

| N. | Name | Function |
|---|---|---|
| 1 | Cpre | Preheat Timing Capacitor |
| 2 | Rpre | Maximum Oscillation Frequency Setting. Low Impedance Voltage Source. See also Cf |
| 3 | Cf | Oscillator Frequency Setting (see also Ring. Rpre) |
| 4 | Ring | Minimum Oscillation Frequency Setting. Low Impedance Voltage Source. See also Cf |
| 5 | OPout | Sense OP AMP Output Low Impedance |
| 6 | OPin− | Sense OP Amp Inverting Input. High Impedance |
| 7 | OPin+ | Sense OP Amp Non-Inverting Input High Impedance |
| 8 | EN1 | Half Bridge Enable |
| 9 | EN2 | Half Bridge Enable |
| 10 | GND | Ground |
| 11 | LVG | Low Side Driver Output |
| 12 | Vs | Supply Voltage with Internal Zener Clamp |
| 13 | N.C. | Non-Connected |
| 14 | OUT | High Side Driver Reference |
| 15 | HVG | High Side Driver Output |
| 16 | Vboot | Bootstrapped Supply Voltage |

Other operational details of the L6574 circuit include a high voltage rail up to 600V and dV/dt immunity ±50 V/ns in full temperature range. The circuit has a driver current capability of 250 mA source and 450 mA, sink switching times are 80/40 ns and rise/fall with 1 nF load. It includes a CMOS shut down input and under voltage lock out. The circuit has preheat and frequency shifting timing and sense OP amp for closed loop control or protection features. It also includes high accuracy current controlled oscillator and integrated boot strap diode with clamping on Vs. It can be included as an SO16, DIP 16 package.

The first and second operational amplifiers can be a micropower quad CMOS voltage comparator that is manufactured and sold under the designation TS339C,I,N by STMicroelectronics. It is a micropower CMOS quad voltage comparator with low voltage output.

The comparator includes a low supply current: 9 $\mu$A typ/comparator and wide single supply range 3V to 16V or dual supplies (±1.5V to ±8V.) It has a low bias current: 1 pA typ and extremely low input offset current: 1 pA typ. The input common-mode voltage range includes GND and high input impedance: $10^{12}\Omega$ typ with fast response time: 1.5 $\mu$s typ for 5 mV overdrive. It is pin-to-pin and functionally compatible with a bipolar LM339.

Figure 2:
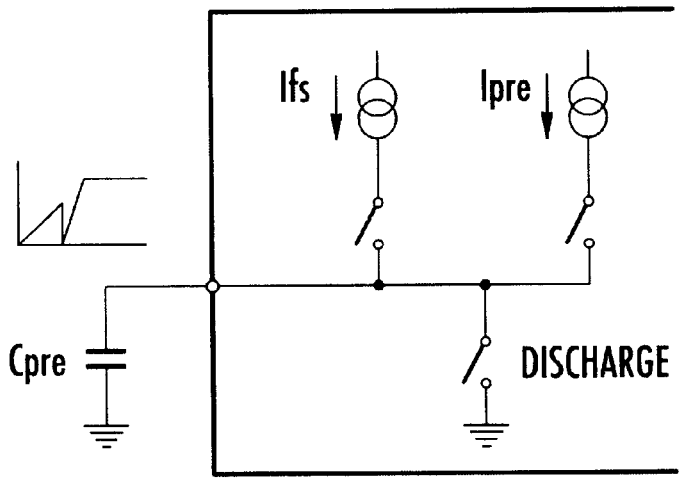
FIG. 2 is a schematic circuit diagram showing the charging and discharging cycle of the preheat capacitor used in the present invention.
Figure 3:
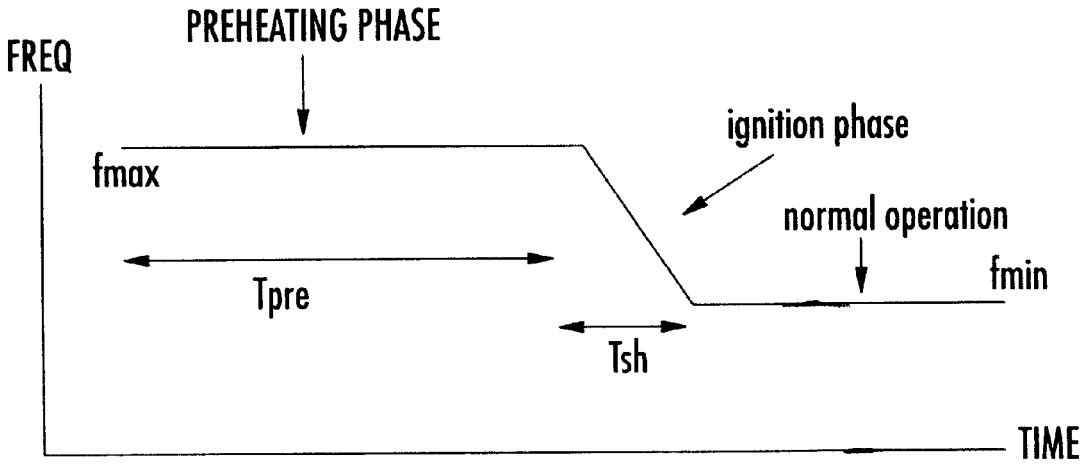
FIG. 3 is a graph showing the frequency versus time plot for the preheating, ignition and operating modes of the ballast control IC without the use of the present invention.
Figure 3A:
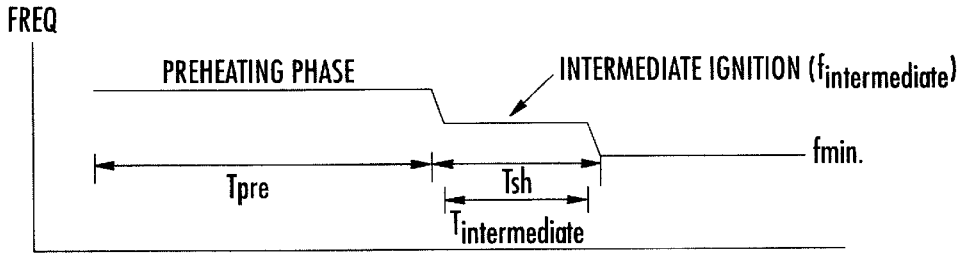
FIG. 3A is a graph showing the frequency versus time plot for the preheating, ignition and operating modes of the ballast control IC with the use of the present invention.

The illustrated circuit is used in conjunction with the Cpre pin on the L6574 Ballast Controller Integrated Circuit. The Cpre pin is used in conjunction with other pins to charge up the preheat capacitor C1. The preheating time is determined by the time it takes for the capacitor to charge up to 3.5V using a constant current. Once the preheat capacitor reaches 3.5V, it is discharged and again begins to charge up a second time, only with a different constant current. During the first portion of the second charging, the output frequency begins to lower in a linear manner until it reaches its final "operating" frequency. The actual voltage on the preheat capacitor at which the frequency ramp stops is determined by an internal reference voltage. The charging and discharging cycle is shown in FIGS. 2 and 3.

The ballast circuit of the present invention modifies the frequency ramp (ignition phase) and the lamp preheat/ignition circuit used for modification is shown by preheat capacitor C1 and the circuit to the right of C1 in FIG. 1. Details of the operation of the circuit will now be described, starting with the description of the preheating function.

Upon the first charging of preheat capacitor C1, the capacitors C1 and C2 are both charged. The voltage on C2 during charging is one diode drop less than the voltage on preheat capacitor C1. This maintains the output of the comparator low (or grounded) and the additional circuitry is essentially "shut down." Once the voltage across preheat capacitor C1 reaches 3.5V, the cpre pin then discharges preheat capacitor C1. C2 is not discharged during this time because the diode D1 is now reversed biased.

As C2 is now at a higher potential than C1, the operational amplifier OP2 is now in a "high" state. With the operational amplifier OP2 output high, a reference voltage on the inverting input of operational amplifier OP1 is now established. At the same time, the capacitor C3 begins to charge with the current from R2 and R4. The resistor R8 is tied to the non-inverting input to keep the output of operational amplifier OP1 high during the preheat period. Because the inverting input of operational amplifier OP1 is now at a higher potential than the non-inverting input, the output of operational amplifier OP1 is at a low or ground potential. This ties the resistor R1 to ground. The next stage of circuit operation follows with ignition.

As C1 begins to charge the second time, the resistor R1, which is in parallel with preheat capacitor C1, drops voltage on C2 but does not contribute initially to the second charging since it is still at a diode drop less than the 3.5V from the first charging.

During the second charging of preheat capacitor C1, the voltage increases on C1 until the voltage is equal to the current output from the cpre pin multiplied by the resistance of R1. During this time, the frequency decreases until the voltage is settled at Icpre *R1. This holds the oscillator frequency steady until R1 is shut off (operational amplifier OP1 output goes high or open). The time that the frequency is held high is determined by charging rate of C3. Once the voltage on C3 reaches the voltage on the inverting input of operational amplifier OP1, the OP1 output goes high and essentially leaves R1 open. The current from the cpre pin now goes fully back into charging C1. As C1 again begins to charge, the oscillator frequency decreases until it reaches its final frequency.

The final frequency is the operating frequency. The point at which this frequency is attained is when the voltage on cpre pin and preheat capacitor C1 is equal to the reference inside the ballast controller integrated circuit 12. The additional circuitry shown to the right of R8 35 includes the two operational amplifiers 42, 44 connected to a reference and receiving a shut down signal as an input, as an example of shut down circuitry that could be used to discharge the capacitors such that the sequence can restart on the next power up of the ballast circuit.

Figure 4:
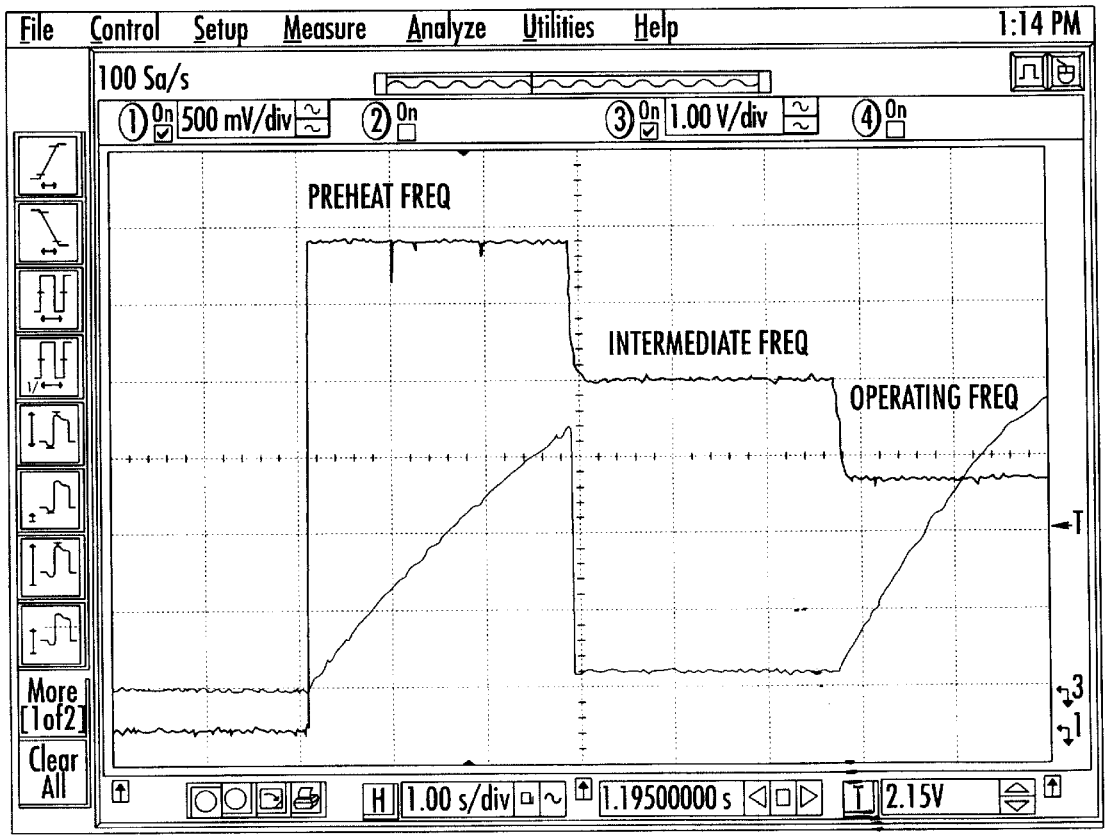
FIG. 4 is an oscillograph of the preheat capacitor along with the accompanying frequency shift.

An oscillograph of preheat capacitor C1 along with the accompanying frequency shift is shown in FIG. 4. As illustrated, the upper trace is a voltage representation of the oscillator frequency while the lower trace is voltage across the preheat capacitor. In the standard application, the ignition ramp is set at 1/10 the preheat time. As shown above, the ignition ramp's intermediate frequency now has an adjustable frequency and duration.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A ballast circuit for operating a lamp comprising:

a lamp preheat/ignition circuit for preheating and igniting the lamp; and a ballast controller integrated circuit operatively connected to the preheat/ignition circuit wherein the lamp preheat/ignition circuit is operatively controlled in a a) preheating mode wherein the lamp is preheated at a preheating frequency for a predetermined period of time;

b) a user programmable intermediate ignition mode wherein the lamp is heated at an intermediate ignition frequency at a desired time period that is lower than the preheating frequency; and c) an operating mode wherein the lamp is operated at a final operating frequency that is lower than the intermediate ignition frequency.

2. A ballast circuit according to claim 1 wherein said lamp preheat/ignition circuit comprises a preheat capacitor operatively connected to said ballast controller integrated circuit wherein the preheat capacitor is charged at a constant current during the preheating mode.

3. A ballast circuit according to claim 2 wherein said preheat capacitor is discharged and then charged a second time at a different constant current from that used in the preheating mode during which the frequency from the intermediate ignition frequency to the final operating frequency lowers in a linear manner.

4. A ballast circuit according to claim 2 wherein said lamp preheat/ignition circuit further comprises at least one capacitor and a pair of operational amplifiers operative with the preheat capacitor and having an inverting input and an output operative for switching among the preheating, intermediate ignition, and operating modes.

5. A ballast circuit for operating a lamp comprising:

a lamp preheat/ignition circuit for preheating and igniting the lamp, said circuit including a preheat capacitor and differential amplifier circuit; and a ballast controller integrated circuit operatively connected to the preheat capacitor, wherein the lamp preheat/ignition circuit is operatively controlled in a a) preheating mode wherein the lamp is preheated at a preheating frequency for a predetermined period of time such that the preheat capacitor is charged at a constant current;

b) a user programmable intermediate ignition mode wherein the lamp is heated at an intermediate ignition frequency that is lower than the preheating frequency; and c) an operating mode wherein the lamp is operated at a final operating frequency that is lower than the intermediate ignition frequency.

6. A ballast circuit according to claim 5 wherein said preheat capacitor is discharged and charged a second time at a different constant current during which the frequency from the intermediate ignition frequency to the final operating frequency lowers in a linear manner.

7. A ballast circuit according to claim 5 wherein said operational amplifier circuit comprises a pair of operational amplifiers that are operative with the preheat capacitor and having an inverting input and output operative for switching among the preheating, intermediate ignition, and operating modes.

8. A ballast circuit according to claim 5 and further comprising a diode and capacitor circuit operatively connected to said preheat capacitor such that the voltage on the capacitor circuit is one diode drop less than the voltage on the preheat capacitor upon initial charging of the preheat capacitor.

9. A ballast circuit according to claim 5 and further comprising an operational amplifier circuit for resetting operation of the ballast circuit.

10. A ballast circuit for operating a lamp comprising:

a lamp preheat/ignition circuit for preheating and igniting the lamp;

a ballast controller integrated circuit operatively connected to the preheat/ignition circuit wherein the lamp preheat/ignition circuit is operatively controlled in a a) preheating mode wherein the lamp is preheated at a preheating frequency for a predetermined period of time;

b) a user programmable intermediate ignition mode wherein the lamp is heated at an intermediate ignition frequency at a desired time period that is lower than the preheating frequency; and c) an operating mode wherein the lamp is operated at a final operating frequency that is lower than the intermediate ignition frequency; and an operational amplifier circuit operatively connected to said ballast controller integrated circuit and lamp/preheat ignition circuit for resetting operation of the ballast circuit.

11. A ballast circuit according to claim 10 wherein said lamp preheat/ignition circuit comprises a preheat capacitor operatively connected to said ballast controller integrated circuit, wherein the preheat capacitor is charged at a constant current during the preheating mode.

12. A ballast circuit according to claim 11 wherein said preheat capacitor is discharged and charged a second time at a different constant current from that used in the preheating mode during which the frequency from the intermediate ignition frequency to the final operating frequency lowers in a linear manner.

13. A ballast circuit according to claim 11 wherein said lamp preheat/ignition circuit further comprises capacitors and a pair of operational amplifiers operative with the preheat capacitor and having an inverting input and output operative for switching among the preheating, intermediate ignition, and operating modes.

14. A method of operating a ballast circuit for a lamp, wherein the ballast circuit comprises a preheat capacitor and ballast controller integrated circuit for charging the preheat capacitor and establishing a user programmable ignition ramp for the lamp comprising the steps of:

charging the preheat capacitor to establish a preheating time period for the lamp at a preheating frequency;

discharging the preheat capacitor while establishing a user programmable intermediate ignition frequency for the lamp that is lower than the preheating frequency; and recharging the preheat capacitor and establishing a final operating frequency for the lamp that is lower than the intermediate ignition frequency.

15. A method according to claim 14 and further comprising the step of initially charging the preheat capacitor at a preheating frequency at a constant current.

16. A method according to claim 15 and further comprising the steps of discharging the preheat capacitor and recharging the preheat capacitor at a constant current different from the current used to charge initially the preheat capacitor.

17. A method according to claim 16 and further comprising the step of lowering the frequency in a linear manner from the intermediate ignition frequency for the lamp to the final operating frequency during the recharging of the preheat capacitor.

18. A method according to claim 14 and further comprising the step of setting the preheat frequency as a maximum programmed oscillator frequency that is output from the ballast controller integrated circuit to the preheat capacitor.

19. A method according to claim 14 and further comprising the step of setting the final operating frequency as a minimum programmed oscillator frequency that is output from the ballast controller integrated circuit to the preheat capacitor.

20. A method according to claim 14 and further comprising the step of establishing the preheating time period by the time period it takes for the capacitor to charge up to a predetermined voltage.

21. A method according to claim 14 and further comprising the step of resetting the ballast circuit using an operational amplifier circuit.

22. A method according to claim 14 and further comprising the step of establishing the final output frequency by a reference within the ballast controller integrated circuit.

23. A method of operating a ballast circuit or a lamp, wherein the ballast circuit comprises a preheat capacitor and ballast controller integrated circuit for charging the preheat capacitor and establishing a programmable ignition ramp for the lamp comprising the steps of:

charging the preheat capacitor to establish a preheating time period for the lamp at a preheating frequency;

discharging the preheat capacitor at a selected rate while establishing a user programmable intermediate output frequency at a desired time period and frequency that is lower than the preheating frequency; and recharging the preheat capacitor to establish a final operating frequency for the lamp that is lower than the intermediate output frequency.

24. A method according to claim 23 and further comprising the step of charging a second capacitor operative with a comparator circuit and maintaining the charge on the second capacitor while establishing the intermediate frequency.

25. A method according to claim 23 and further comprising the step of initially charging the preheat capacitor at a preheating frequency using a constant current generated by the ballast controller integrated circuit.

26. A method according to claim 23 and further comprising the steps of discharging the preheat capacitor and then recharging the preheat capacitor at a constant current different from the current used to charge initially the preheat capacitor.

27. A method according to claim 26 and further comprising the step of lowering the frequency in a linear manner from the intermediate frequency to the final operating frequency during the recharging of the preheat capacitor.

28. A method according to claim 23 and further comprising the step of setting the preheating output frequency as a maximum programmed oscillator frequency that is output from the ballast controller integrated circuit to the preheat capacitor.

29. A method according to claim 23 and further comprising the step of setting the final operating frequency as a minimum programmed oscillator frequency that is output from the ballast controller integrated circuit to the preheat capacitor.

30. A method according to claim 23 and further comprising the step of establishing the preheating time period by the time period it takes for the preheat capacitor to charge up to a predetermined voltage.

31. A method according to claim 23 and further comprising the step of resetting the ballast circuit using an operational amplifier circuit.

32. A method according to claim 23 and further comprising the step of establishing the final frequency by a reference within the ballast controller integrated circuit.

* * * * *